United States Patent [19]

McMullen et al.

[11] 4,450,052

[45] May 22, 1984

[54] ZINC AND NICKEL TOLERANT TRIVALENT CHROMIUM PLATING BATHS

[75] Inventors: Warren H. McMullen, East Brunswick; Hyman Chessin, Brick Township, Ocean County, both of N.J.; Denise Siracusa, Staten Island, N.Y.

[73] Assignee: M&T Chemicals Inc., Woodbridge, N.J.

[21] Appl. No.: 402,657

[22] Filed: Jul. 28, 1982

[51] Int. Cl.[3] ..... C25D 3/06

[52] U.S. Cl. ..... 204/51; 204/43 R

[58] Field of Search ..... 204/51, 43 R, 43 T, 204/105 R, 123

[56] References Cited

U.S. PATENT DOCUMENTS 2,822,326 2/1958 Safranek ..... 204/43 R

FOREIGN PATENT DOCUMENTS 7005999 10/1970 Netherlands ..... 204/51

*Primary Examiner*—G. L. Kaplan

*Attorney, Agent, or Firm*—Stanley A. Marcus; Franklyn Schoenberg; Sheldon H. Parker

[57] ABSTRACT

Nickel and/or zinc contamination can be handled by increasing the bath's level of tolerance to nickel and zinc, thereby eliminating the need to use precipitants. The instant invention relates to the use in a trivalent chromium bath contaminated with zinc and/or nickel, or an effective amount of a compound represented by the formula R-S, where S is selected from the group consisting of sulfinates, sulfonates, and the acids and soluble salts thereof, and R is either an aliphatic group having from 1 to 6 carbons, or an aromatic or heterocyclic group having up to 12 carbons. Preferably R is an unsaturated hydrocarbon and contains carbon to carbon unsaturation alpha or beta to the sulfur atom.

13 Claims, No Drawings

ZINC AND NICKEL TOLERANT TRIVALENT CHROMIUM PLATING BATHS

BACKGROUND OF THE INVENTION

1. Field of the Invention

This invention relates to the electrodeposition of chromium from trivalent chromium plating baths.

2. Brief Description of the Prior Art

The success of a trivalent chromium plating operation frequently depends on the prevention of interference from common metal ions such as iron, nickel, copper, zinc and lead which have entered the bath. In general, trivalent chromium plating processes are known to have very low tolerance to metallic impurities. The tolerance of the bath to zinc and copper is especially low, thus necessitating the exercising of extreme care to avoid contamination with these metals. Copper can be plated out using low current density electrolysis, but zinc does not plate out well and consequently poses a greater problem.

Typically, zinc contamination is unavoidable when the plating is carried out on brass or zinc diecastings. Zinc is extremely active and will dissolve readily under the acidic condition of the bath, and consequently, dropped parts must be removed rapidly. In the case of parts that are not completely plated prior to chromium plating, as for example due to extremely low current density areas, some dissolution is unavoidable. As noted, for example, in U.S. Pat. No. 4,093,521, zinc should be present at a level of below 20 ppm in order to avoid plating faults. At a level of 20 ppm, or greater, a whitish hazy band will appear at the lower limit of the plating range. As the zinc level increases in the bath, the coverage is reduced and the white haze moves into the higher current density areas.

The only method commonly employed for the removal of zinc, are the precipitation processes, as described for example, in U.S. Pat. No. 4,038,160. The process involves the use of a water soluble ferrocyanide to precipitate trace metal contaminants including zinc, from the bath. The process is time consuming and it is known that cathodic filming can occur. The film is so heavy that, in some instances, parts plated in a solution which employs ferrocyanide must be physically wiped down to remove the adherent powder.

Moreover, it is pointed out in the patent that an addition of ferrocyanide in amounts in excess of those required to eliminate faults may cause a deterioration in the performance of the bath. Incremental ferrocyanide addition is used in combination with observation of the deposit in order to determine the proper concentration of ferrocyanide. An excess of ferrocyanide is combated by employing additional metal such as nickel, zinc, iron or copper. The process control employs a "rule of thumb" to equate ferrocyanide concentration to contaminant concentration.

Even though the solution tolerance to nickel may be greater than to most other metals, nickel contamination is especially difficult to contend with because ordinarily, it does not readily plate out. In some instances, nickel is added to the plating bath as part of its composition, as seen for example, in U.S. Pat. No. 3,954,574. Nickel can be present to saturation for the purpose of codeposition. The level of nickel tolerance is inversely related to the required quality level of the appearance of the deposit. In this regard it is noted that the plating baths of U.S. Pat. No. 4,093,521 can only tolerate up to 150 ppm of nickel, or up to 100 ppm nickel in the presence of iron, with a combined concentration of up to 150 ppm of iron and nickel.

Nickel contamination removal commonly involves the use of precipitation with an agent such as dimethylglyoxime. The high cost of the agent and the difficulty of precipitating the resultant flocculant precipitant render this technique less than perfect. A ferrocyanide salt can also be used but not without problems, as previously noted.

It is noted that some of the compounds of the instant invention are used as additives in nickel plating. However, not all nickel brighteners are useful in trivalent chromium plating baths for increasing the baths' tolerance to nickel impurities. Surprisingly, it was found that some of these additives were also beneficial in handling zinc impurities, even though typical brighteners used in zinc plating, such as aldehydes, had no beneficial effect in trivalent chromium plating baths containing zinc contaminants.

SUMMARY OF THE INVENTION

It has now been found that nickel and/or zinc contamination can be handled by increasing the bath's level of tolerance to these metals, thereby eliminating the need to remove them through the use of precipitants or other means. The instant invention relates to the use in a trivalent chromium bath contaminated with zinc and/or nickel, of an effective amount of a compound represented by the formula R-S, where S is selected from the group consisting of sulfinates, sulfonates, and the acids and soluble salts thereof, and R is either an aliphatic group having from 1 to 6 carbons, or an aromatic, alkyl aromatic or heterocyclic group having up to 12 carbons. Preferably R is an unsaturated hydrocarbon and contains carbon to carbon unsaturation alpha or beta to the sulfur atom.

DESCRIPTION OF THE INVENTION INCLUDING THE PREFERRED EMBODIMENTS

In the following examples, Hull Cell testing was used to determine the effect with and without the additive of the instant invention. Unless otherwise specified, the term "trivalent chromium plating bath" refers to any of the typical plating solutions based on trivalent chromium, a complexing agent and conductivity salts as their basic constituents. These are well known and include plating baths such as those mentioned in U.S. Pat. Nos. 3,954,574, 4,141,803 and 4,167,460. The term "normal trivalent chromium plating bath" refers to one that is operative and free from harmful metallic impurities.

As indicated in the aforenoted patents, the bath could contain chromic sulfate, potassium and ammonium chloride, boric acid, ammonium formate, acetic acid and ferrous ammonium sulphate, or other standard ingredients. Although the invention should not be construed as being limited to any particular theory of operation, it would appear that the additive functions as a chelating or coupling agent and does not serve as a precipitating agent.

Accordingly, the additives of the instant are applicable to trivalent chromium plating baths in general.

In the following tests, the baths were kept at ambient temperature and mild agitation was provided near the cathode by a stirring bar and magnetic stirrer. The freshly plated nickel cathodes which were employed were water rinsed and acid dipped and then plated in the 500 ml Hull Cell with a graphite anode for three minutes at 5 amperes.

Control 1

A trivalent chromium plating solution containing 50 ppm of zinc was used to plate a Hull Cell panel. The resulting deposit was clear bright from the high current density edge down to 13 amp/dm$^2$(asd) and had a whitish haze from about 3 to 13 asd.

EXAMPLE 1

To the foregoing bath was added 0.88 g/l sodium allyl sulfonate. The haziness was totally eliminated, leaving a deposit that was only slighly uneven in color.

EXAMPLE 2

To the bath of Example 1 was added an additional 0.88 g/l sodium allyl sulfonate. In addition to the haziness being eliminated, the deposit color was evened out.

Control 2

A trivalent chromium plating solution containing standard ingredients as well as 50 ppm of zinc and 140 ppm of nickel was used to plate a Hull Cell panel. The resulting deposit had a white haze from about 3 to 13 asd. In addition the deposit was dark from 2 to 3 asd.

EXAMPLE 3

To the bath of Control 2 was added 0.05 g/l propargyl sulfonate. The haziness and darkness were eliminated, leaving an exceptional deposit to 3 asd on the Hull Cell.

EXAMPLE 4

To the bath of Control 2 was added vinyl sulfonate, until a concentration of 0.30 g/l was reached. The Hull Cell panel had a uniform, haze-free deposit to 3 asd.

Control 3

A trivalent chromium plating solution containing standard ingredients, as well as 50 ppm of zinc and 150 ppm of nickel was used to plate a Hull Cell panel. A hazy deposit which was additionally dark in the low current density area was produced.

EXAMPLE 5

To the bath of Control 3 was added 0.23 g/l sodium benzene sulfinate in a stepwise fashion. All of the haziness was eliminated on the Hull Cell panel. The deposit was still slightly dark in the low current density.

EXAMPLE 6

The sodium benzene sulfinate level of Example 5 was increased to 0.33 g/l. Almost all darkness and haziness in the low current density area was gone leaving a nice looking deposit.

EXAMPLE 7

To a bath having the same composition as that of Control 3, was added 0.23 g/l sodium toluene sulfinate. All of the haziness was eliminated on the Hull Cell panel.

Control 4

A trivalent chromium plating solution containing standard ingredients as well as 100 ppm of zinc was set up in 500 ml Hull Cells for low current density electrolysis. The solution was electrolyzed at an average current density of 3 asd for 6 amp-hrs/l. Spectrophotometric analysis of the bath indicated the zinc level was reduced to 78 ppm.

EXAMPLE 8

The trivalent chromium plating solution of Control 4, with an addition of 2.2 g/l of sodium allyl sulfonate was electrolyzed at 3 asd for 6 amp-hrs/l. Spectrophotometric analysis of the bath indicated the zinc level was reduced to 30 ppm, indicating a much greater plate out rate for the bath with the 2.2 g/l of sodium allyl sulfonate.

Control 5

A trivalent chromium plating solution containing standard ingredients, as well as 100 ppm of zinc, was set up in 500 ml Hull Cells for low current density electrolysis. The solution was electrolyzed at 3 asd for 138 amp-hrs/l. Spectrophotometric analysis of the bath indicated the zinc level was reduced to 37 ppm.

EXAMPLE 9

The trivalent chromium plating solution of Control 5, with an addition of 0.44 g/l of sodium allyl sulfonate was, in the manner of Control, electrolyzed at 3 asd for 138 amp-hrs/l. Spectrophotometric analysis of the bath indicated the zinc level was reduced to 22 ppm, indicating a much greater plate out rate for the bath with the 0.44 g/l of sodium allyl sulfonate.

Control 6

A trivalent chromium plating solution containing standard ingredients as well as 300 ppm of nickel was used to plate a Hull Cell panel. Black streaking from 4 to 20 asd was observed.

EXAMPLE 10

To the foregoing bath was added 1.75 g/l of sodium allyl sulfonate and another panel was run. All of the streaking had disappeared and coverage was increased considerably, from 1.5 asd to the end of the panel.

Control 7

A trivalent chromium plating solution containing standard ingredients, as well as 880 ppm of nickel was used to plate a Hull Cell panel. The deposit had heavy streaking across the Hull Cell panel.

EXAMPLE 11

To the bath of Control 7 was added 0.9 g/l of sodium allyl sulfonate and another panel was run. Almost all of the streaking had disappeared and there was a bright deposit across the Hull Cell panel.

Control 8

A trivalent chromium plating solution containing standard ingredients as well as 300 ppm of nickel was used and a Hull Cell panel was run giving the typical nickel effect of black streaking from 4 to 20 asd.

EXAMPLE 12

To the bath of Control 8 was added 0.44 g/l of sodium allyl sulfonate. This eliminated almost all of the streaking on the Hull Cell panel and resulted in a bright deposit across the panel.

Control 9

A trivalent chromium bath was analyzed spectrophotometrically and determined to contain 380 ppm of nickel. Following the standard procedure, a Hull Cell panel was run and observed to have heavy black streaking from about 2 to 20 asd.

Additionally, additives which were found to fail to produce the desired effect include propargyl alcohol, saccharin, butynediol, glutaraldehyde, o-chlorobenzaldehyde and benzyl acetone.

EXAMPLE 13

Propargyl sulfonate was added in increasing amounts to the bath of Control 9 and Hull Cell panels were run after each addition of the sulfonate. At 0.05 g/l concentration level, the intensity of the streaking was greatly reduced. At a 0.25 g/l concentration level, all of the black streaking previously observed, had disappeared.

EXAMPLE 14

Hydroxysubstituted pyridinium propyl sulfobetaine was added stepwise to a bath formulated as in Control 9. Streaking was reduced at a concentration level of 0.12 g/l and was reduced even further at a concentration level of 0.48 g/l.

EXAMPLE 15

3-Pyridine sulfonic acid was added stepwise to a bath formulated as in Control 9. The heavy black streaking which was exhibited to about 3 asd with no deposition at lower current densities was considerably reduced at a concentration level of 0.48 g/l and was virtually eliminated at a concentration level of 5.5 g/l. At the concentration level as low as 0.08 g/l the throw was increased down to 0.5 asd.

EXAMPLE 16

3-hyroxypropane sulfonic acid was added stepwise to a bath formulated as in Control 9. At a concentration level of 0.10 g/l streaking at the cathode was decreased. Further additions were made with an even greater reduction in streaking.

EXAMPLE 17

Sodium benzene sulfinate was added stepwise to a bath formulated as in Control 9. The addition of 0.10 g/l resulted in an improved deposit across the panel although there was still heavy black streaking from about 3 to about 30 asd. However, at a concentration level of 1.5 g/l the streaking was less intense and at a concentration level of 6.4 g/l, only a very small amount of streaking remained.

EXAMPLE 18

Two trivalent chromium solutions containing about 350 ppm of nickel were setup in 500 ml Hull Cells to compare the plate out rate of nickel with and without the addition of a compound of the present invention. Solution A served as a control for the test. To the solution B, 4.4 g/l of sodium allyl sulfonate was added. The solutions were electrolyzed in series for 121 amp-hours/l at 3 asd. Afterwards they were analyzed for nickel spectrophotometrically. The results were as follows:

| Solution | Ni, ppm |
|---|---|
| A | 330 |
| B | 236 |

The results clearly indicate a large increase in the plate out rate of nickel with the addition of sodium allyl sulfonate.

There is some appearance of similarity of the additives of the instant invention to the sulfonated surfactants with 8 to 20 alkyl carbons of, for example, U.S. Pat. No. 3,954,574, which discloses the use of surfactants in trivalent chromium baths baths. However, the differences between the instant additives and surfactants, as they apply to trivalent chromium plating will become apparent from the following comparison tests.

Control 10

Hull Cell testing was carried out on a standard working bath, which was kept at ambient temperature, and mildly agitated using a stirring bar and magnetic stirrer. Freshly painted nickel cathodes were used. They were water rinsed, acid dipped and then plated in the test solution for three minutes using five amperes. To the bath, 400 ppm of nickel was added and a Hull Cell panel was run. It exhibited a typical nickel effect, exhibiting heavy jagged streaking from about 4 to 20 asd. A sulfonate surfactant, dihexyl sulfonsuccinic acid was added to the bath and further tests were made. At 0.01 g/l, the concentration typically found in a plating bath, no effect was noted. At 0.1 g/l, not only was there no improvement, but a haze developed in the low current density which was attributed to the presence of the surfactant.

What is claimed is:

1. In a trivalent chromium electroplating bath contaminated with zinc and/or nickel, the improvement comprising an effective amount to overcome contamination effects of a compound represented by the formula R-S, where:

S is selected from the group consisting of sulfinates, and the acids and soluble salts thereof, and R is an aliphatic group having from 1 to 6 carbons, or an aromatic, alkyl aromatic or heterocyclic group having up to 12 carbons.

2. The bath of claim 1, wherein R is an unsaturated hydrocarbon.

3. The bath of claim 1, wherein R contains carbon to carbon unsaturation alpha to the sulfur atom.

4. The bath of claim 1, wherein R contains carbon to carbon unsaturation beta to the sulfur atom.

5. The bath of claim 1, wherein R-S is toluene sulfinate.

6. The bath of claim 1, wherein R-S is benzene sulfinate.

7. In a trivalent chromium electroplating bath contaminated with zinc and/or nickel, the improvement comprising an effective amount to overcome contamination effects of a compound represented by the formula R-S, where:

S is selected from the group consisting of vinyl sulfonate, allyl sulfonate, propargyl sulfonate and mixtures thereof; and R is an aliphatic group having from 1 to 6 carbons, or an aromatic, alkyl aromatic or heterocyclic group having up to 12 carbons.

8. The bath of claim 7, wherein R-S is vinyl sulfonate.

9. The bath of claim 7, wherein R-S is allyl sulfonate.

10. The bath of claim 7, wherein R-S is propargyl sulfonate.

11. The bath of claim 7, wherein R is an unsaturated hydrocarbon.

12. The bath of claim 7, wherein R contains carbon to carbon unsaturation alpha to the sulfur atom.

13. The bath of claim 7, wherein R contains carbon to carbon unsaturation beta to the sulfur atom.

* * * * *